United States Patent [19]

Houp

[11] 4,213,019

[45] Jul. 15, 1980

[54] OVERHEAD DOOR CABLE SAFETY DEVICE

[75] Inventor: Robert L. Houp, St. Joseph, Mo.

[73] Assignee: J. R. Weaver, Inc., St. Joseph, Mo.

[21] Appl. No.: 919,409

[22] Filed: Jun. 26, 1978

[51] Int. Cl.[2] ..... B65H 25/14; B66D 1/48

[52] U.S. Cl. ..... 200/61.13; 200/61.18; 200/47; 254/271

[58] Field of Search ..... 200/61.13, 61.14, 61.15, 200/61.18, 61.41, 61.42, 47, 153 T, 332, 331; 254/173 R, 175

[56] References Cited

U.S. PATENT DOCUMENTS

| | | | |
|---|---|---|---|
| 2,348,987 | 5/1944 | Lock | 254/173 R |
| 2,754,382 | 7/1956 | Francis | 200/61.18 |
| 3,208,729 | 9/1965 | Townsen | 254/173 R |
| 3,681,554 | 8/1972 | Arthur | 200/332 |

*Primary Examiner*—James R. Scott

*Attorney, Agent, or Firm*—John H. Widdowson

[57] ABSTRACT

An overhead door cable safety device for suspending adjacent a cable drum on an overhead door assembly and monitoring the condition and location of the cable on the drum. The cable when becoming loose on the cable drum or frayed contacting the cable safety device, which in turn closes an electrical switch for signalling the operator of the overhead door that the cable on the cable drum is in need of repair.

1 Claim, 5 Drawing Figures

OVERHEAD DOOR CABLE SAFETY DEVICE

BACKGROUND OF THE INVENTION

The subject invention relates broadly to a cable safety device for monitoring the condition of a cable wrapped around a cable drum and more particularly, but not by way of limitation, to the monitoring of a cable on a cable drum used in raising and lowering overhead doors.

In the operation of residential and industrial overhead doors used for garages, warehouses, and the like, the overhead doors are counterbalanced through the use of a helically wound torsion spring. The spring transmits a torque equal to the weight of the door. A properly counterbalanced door may be raised and lowered with only a force sufficient to overcome the rolling friction of the rollers attached to the door.

In larger electrically operated doors, the door is raised by introducing a force on the cable sufficient to overcome the weight of the door. The door is lowered by gravity. If a door should be temporarily restrained when it is lowered, the cable on the drum may become loose and disengaged from around the drum. If the cable becomes disengaged and the restraint on the door is small, the door will fall. When the door falls, the cable often will not hold the free falling weight of the door thereby causing the door to crash on the floor. The falling of a large overhead door may cause damage to the door and danger to the personnel working near the door. The subject invention provides a means for eliminating this dangerous condition.

Prior to the subject invention, there has been no apparatus for alerting the operator of overhead doors that the door cable on the drum has become disengaged or unravelled and maintenance on the door is required.

SUMMARY OF THE INVENTION

The subject invention provides a device for indicating to an operator of an overhead door that the overhead door cable has become disengaged, frayed, or unravelled on the cable drum. The device may be used to activate an audio or visual signal. The device may also be used to activate a brake to prevent the free fall of the overhead door or stop the electrical power in the operation of an electrically operated overhead door until the condition of the cable on the cable drum is corrected.

The cable safety device is designed so that no continuous physical contact is made with the cable when the cable is in proper working order thereby reducing the wear of parts on the device.

The subject invention is simple in design, may be used for various sizes of overhead doors, and may be adapted for different sizes and shapes of cable drums. Also, the invention is easy to install on existing overhead doors.

The overhead cable safety device includes a mounting bracket for attaching to the side of the overhead cable drum. An elongated bolt is attached to the mounting bracket and disposed parallel to the length of the cable drum. Suspended from the elongated bolt and slidably mounted thereto is a "U" shaped monitoring arm. The "U" shaped monitoring arm includes a first end portion, a second end portion, and a center portion. The center portion is disposed in a spaced relationship adjacent the cable wrapped around the cable drum. Also, attached to the elongated bolt is a switch mounting bracket having a pair of electrical switches mounted thereon. The switch contact arms of the electrical switches are positioned adjacent the ends of the first end portion and second end portion of the monitoring arm. The first end portion and second end portion of the monitoring arm include coil springs for biasing the monitoring arm toward the cable drum. When the cable on the cable drum becomes disengaged, unravelled, or frayed, the cable moves outwardly away from the cable drum contacting the center portion of the monitoring arm overcoming the bias of the coil springs. The first end portion and second end portion of the arm move upward toward the switch contact arms and close the electrical switches. The switches may now stop the electrical power to the electric door, signal the operator that there has been a malfunction of the cable, or apply brakes to the overhead door to prevent the door from falling.

The advantages and objects of the invention will become evident from the following detailed description of the drawings when read in conjunction with the accompanying drawings which illustrate the preferred embodiments of the invention.

DETAILED DESCRIPTION OF THE DRAWINGS

Figure 1:
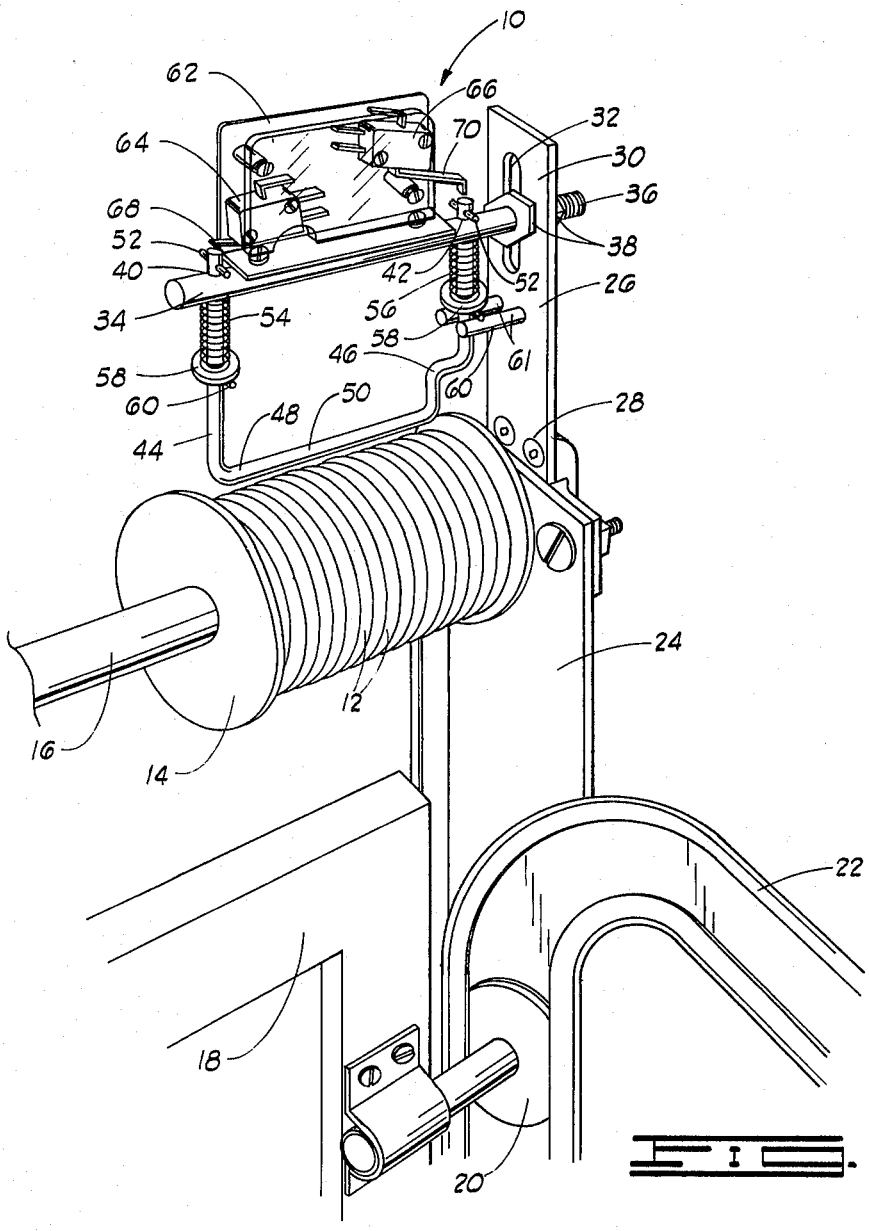
In FIG. 1, a perspective view of the overhead door cable safety device is shown attached to a portion of the overhead door assembly and suspended over an overhead door cable wrapped around a cable drum.

In FIG. 1, a perspective view of the overhead door cable safety device is shown and is designated by general reference numeral 10. The device 10 is suspended above and adjacent a cable 12 wrapped around a cable drum 14 attached to a drum shaft 16. Also shown in FIG. 1 is a portion of an overhead door 18 having rollers 20 attached thereto and received in a roller guide 22. Mounted adjacent the roller guide 22 is a drum shaft mounting bracket 24 for supporting the drum shaft 16.

The device 10 includes a mounting bracket 26 vertically disposed and having a first end portion 28 bolted to the top of the drum shaft mounting bracket 24. A second end portion 30 of the mounting bracket 26 includes a vertical slot 32 for receiving an elongated bolt 34 having a threaded end portion 36 which is secured to the mounting bracket 26 by nuts 38. The elongated bolt 34 is horizontally adjusted above the length of the overhead drum 14. The bolt 34 further includes a pair of apertures 40 and 42 for receiving the ends of a first end portion 44 and second end portion 46 of a "U" shaped monitoring arm 48. The monitoring arm 48 further includes a center portion 50 which extends along the length of the cable drum 14 and is disposed in a spaced relationship adjacent the top of the cable 12 wrapped around the drum 14. The ends of the first end portion 44 and second end portion 46 of the monitoring arm 48 extend upwardly through the apertures 40 and 42 and are pinned to the bolt 34 by retaining pins 52. The monitoring arm 48 is biased downwardly by a pair of coil springs 54 and 56 disposed around the first end portion 44 and second end portion 46 and retained thereon by washers 58 and retaining pins 60. The monitoring arm 48 is guided in a vertical plane by a pair of horizontal guide arms 61 attached to the side of the mounting bracket 26. Attached to the top of the elongated bolt 34 is an electrical switch mounting bracket 62 having a pair of electrical switches 64 and 66 mounted thereon. Switch 64 includes a switch contact arm 68 which is disposed adjacent the end of the first end portion 44 of the monitoring arm 48. The electric switch 66 includes a switch contact arm 70 which is disposed adjacent the end of the second end portion 46 of the monitoring arm 48. In FIG. 1, the ends of the first end portion 44 and second end portion 46 of the monitoring arm 48 are shown adjacent but not contacting the switch contact arms 68 and 70.

Figure 2:
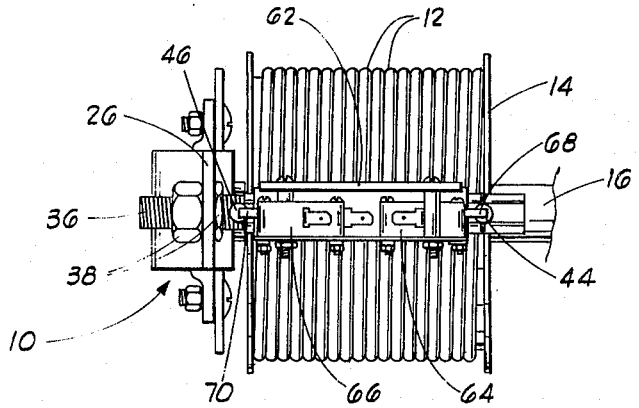
FIG. 2 is a top view of the device.

In FIG. 2, a top view of the cable safety device 10 is seen positioned above the cable 12 wrapped around the cable drum 14. In this view, the contact arms 68 and 70 of electric switches 64 and 66 can be seen centered on and disposed above the ends of the first end portion 44 and second end portion 46 of the monitoring arm 48.

Figure 3:
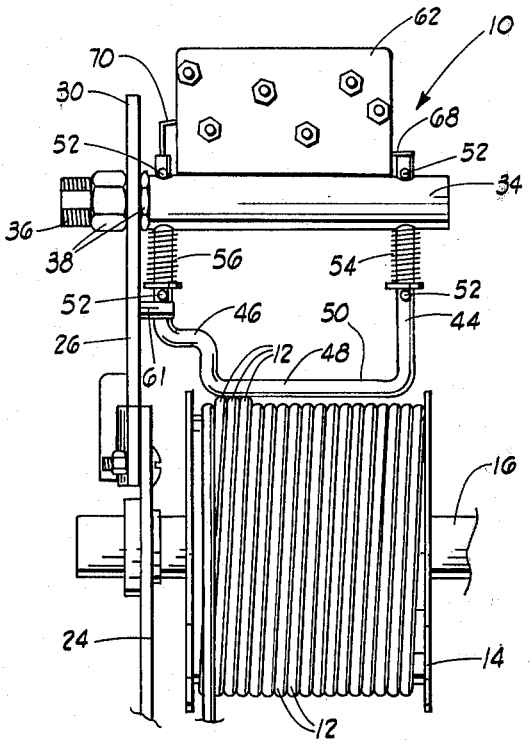
FIG. 3 is a rear view of the device.

In FIG. 3, a rear view of the device 10 is seen with a portion of the cable 12 on the left hand side of the drum 16 disengaged from the drum 14 and extending outwardly therefrom. When the cable 12 becomes disengaged, unravelled, or frayed, the outwardly extending portion of the cable 12 contacts the center portion 50 of the monitoring arm 48. The slightest amount of contact on the monitoring arm 44 is sufficient to overcome the bias force of the springs 54 and 56, thereby urging the first end portion 44 and second end portion 46 of the monitoring arm 48 upwardly with the ends of the first end portion 44 and second end portion 46 contacting the switch contact arms 68 and 70 thereby activating the electrical switches 64 and 66. The switches 64 and 66 may be wired to an electrical signal such as an audio or visual alarm for alerting the operator of the overhead door 18. Also, the switches may be wired to some type of overhead brake for stopping the movement of the overhead door of if the overhead door is electrically operated, the switches may be used to switch off the electrical power to the overhead door 18 thereby stopping it's travel. While the two electrical switches 64 and 66 are showing, it should be appreciated that any number of electrical switches may be wired as desired and activated by the movement of the monitoring arm 48.

Figure 4:
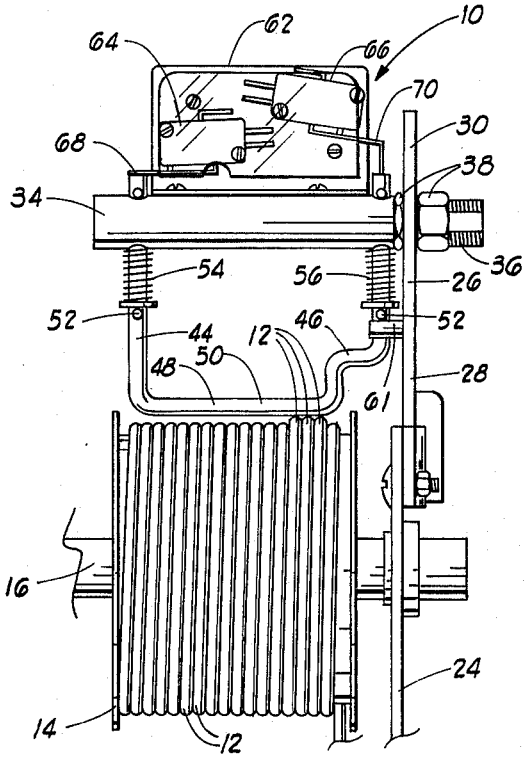
FIG. 4 is a front view of the device showing a portion of the cable becoming disengaged on the drum and contacting the monitoring arm of the device.

In FIG. 4, a front view of the cable safety device 10 is shown with the cable 12 being disengaged on the right hand side of the drum 14 and raising the monitoring arm 48 for activating the switches 64 and 66. In both FIGS. 3 and 4 the ends of the first end portion 44 and second end portion 46 are shown in contact arms with the switch contacts 68 and 70 and closing the switches 64 and 66.

Figure 5:
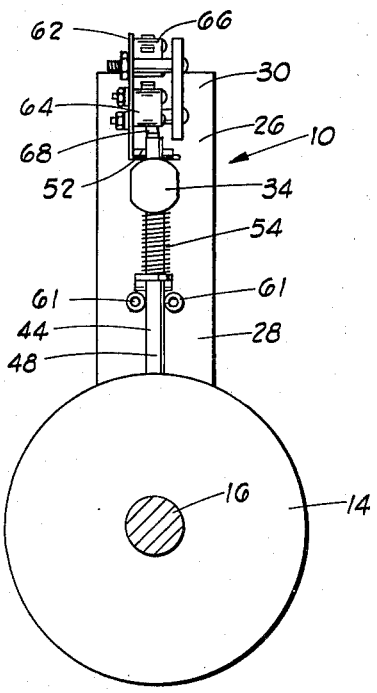
FIG. 5 is a side view of the device.

In FIG. 5, a side view of the overhead door cable safety device 10 is shown. Also seen in this view, are the monitoring arm guides 61 for holding the monitoring arm 48 in a vertical position above the cable 12 on the drum 14. While the device 10 is shown attached to the drum shaft mounting bracket 24 and suspended above the top of the cable drum 14, it can be appreciated that the device 10 could be used equally well at various positions adjacent the drum 14 depending on how the drum 14 is mounted and the necessary space required so that the device 10 may be mounted in a spaced relationship to the cable 12 wrapped around the drum 14. It should be noted that the device 10 does not contact the cable 12 or drum 14 under normal operating conditions, therefore, there is no wear of operating parts except for the continuous bias pressure of the springs 54 and 56 urging the monitoring arm 48 in a position adjacent the cable 12 wrapped around the drum 14. When the device 10 has been activated, the electrical swithces 64 and 66 will remain closed until the cable 12 is replaced or properly positioned around the cable drum 14 and the center portion 50 of the monitoring arm 48 is no longer in contact with the cable 12.

Changes may be made in the construction and arrangement of the parts or elements of the embodiment as disclosed herein without departing from the spirit or scope of the invention as defined in the following claims.

I claim:

1. An overhead door cable safety device for suspending above an overhead door cable wrapped around a cable drum, the device used for signaling the operator of the overhead door or stopping the operation of the overhead door, the device comprising:

a mounting bracket adjacent one end of the cable drum;

an elongated bolt having one end attached to said mounting bracket, said elongated bolt parallel to and disposed above the length of the cable drum;

a monitoring arm having a structure defined by a pair of apertures and including a first end portion, a second end portion, and a center portion, disposed adjacent to and above the cable wrapped around the cable drum, the first end portion and second end portion slidably mounted in said apertures of said elongated bolt; and electric switch means disposed adjacent the ends of the first end portion and second end portion of said monitoring arm, said electric switch means having contact arms for being engaged by said first end portion and said second end portion to open or close an electrical circuit as required to signal the operator, said electric switch means activated when contacted by the ends of the first end portion and second end portion of said monitoring arm when the center portion of said monitoring arm is contacted by the cable on the cable drum;

said electrical switch means includes an electric switch mounting bracket attached to said elongated bolt and a pair of electrical switches attached to said electrical switch mounting bracket, said electrical switches having said contact arms disposed adjacent the ends of the first end portion and second end portion of said monitoring arm;

coil springs disposed around the first end portion and second end portion of said monitoring arm for biasing said monitoring arm toward the cable wrapped around the cable drum, the tension force of said springs overcome when the cable on the cable drum contacts the center portion of said monitoring arm thereby allowing said monitoring arm to be raised on said elongated bolt with the first end portion and second end portion of said monitoring arm contacting the contact arms of said electrical switches; and guide arms attached to and extending outwardly from said mounting bracket and positioned on both sides of the second end portion of said monitoring arm for guiding said monitoring arm when said monitoring arm is contacted by the cable; said mounting bracket having a structure defined by a vertical slot to raise or lower said elongated bolt.

* * * * *